US006698742B2

(12) United States Patent
Hansch

(10) Patent No.: US 6,698,742 B2
(45) Date of Patent: Mar. 2, 2004

(54) APPARATUS FOR APPLYING SUPPLEMENTARY PRODUCTS TO PRINTED PRODUCTS

(75) Inventor: Egon Hansch, Wetzikon (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 10/192,292

(22) Filed: Jul. 10, 2002

(65) Prior Publication Data

US 2003/0075853 A1 Apr. 24, 2003

(30) Foreign Application Priority Data

Jul. 10, 2001 (CH) ..... 2001/1263/01

(51) Int. Cl.[7] ..... B65H 29/68

(52) U.S. Cl. ..... 270/52.22; 270/52.19; 270/52.14; 271/204; 271/69; 271/82

(58) Field of Search ..... 270/52.01, 52.14, 270/52.19, 52.22, 52.2; 271/69, 204, 208, 206, 314, 315, 81, 82

(56) References Cited

U.S. PATENT DOCUMENTS

| | | | | |
|---|---|---|---|---|
| 5,632,476 A | | 5/1997 | Stauber | |
| 5,636,832 A | | 6/1997 | Honegger et al. | |
| 5,645,679 A | | 7/1997 | Hansch | |
| 5,660,382 A | * | 8/1997 | Meier | 270/52.16 |
| 6,161,827 A | * | 12/2000 | Eugster et al. | 270/52.14 |
| 6,182,960 B1 | * | 2/2001 | Keller et al. | 271/82 |
| 6,196,538 B1 | * | 3/2001 | Stauber et al. | 271/69 |
| 6,270,076 B1 | * | 8/2001 | Reist | 271/302 |
| 6,533,016 B2 | * | 3/2003 | Hansch | 156/556 |

FOREIGN PATENT DOCUMENTS

| | | |
|---|---|---|
| DE | 42 00 393 A1 | 7/1993 |
| WO | WO 99/06285 | 2/1999 |

OTHER PUBLICATIONS

Inventor: Egon Hansch; Title: Method and Apparatus for Joining Supplementary Products to Printed Products; Publication Date: Jun. 28, 2001; Publication No. US 2001/0004918 A1.

U.S. Patent Application No. US 2001/0004918 A1, Hansch, Method and Apparatus for Joining Supplementary Products, 10 pages, published Jun. 28, 2001.

* cited by examiner

*Primary Examiner*—Patrick Mackey
(74) *Attorney, Agent, or Firm*—Brinks Hofer Gilson & Lione

(57) ABSTRACT

A number of circulatory elements arranged one behind the other are driven in a direction of circulation and have a suction element and a supporting element in each case on the first side and on the second side. The circulatory elements receive a supplementary product at the pick-up location and transfer the same, in a first mode of operation, to the respectively preceding circulatory element. In a second mode of operation, no transfer takes place. This results in it being possible for the supplementary products received in the same manner to be brought into abutment optionally against the leading side or trailing side of the printed products and pressed on there.

19 Claims, 6 Drawing Sheets

APPARATUS FOR APPLYING SUPPLEMENTARY PRODUCTS TO PRINTED PRODUCTS

BACKGROUND OF THE INVENTION

The present invention relates to an apparatus which is intended for supplying supplementary products to printed products and pressing them onto the latter and has the features of the preambles of patent claims 1 and 10.

An apparatus of this type is known from EP Patent Application No. 00122324.7 (Publication No. EP-A-1 112 861). It has circulatory elements which are provided, on the one hand, with a suction element and, on the other hand, with a supporting element and are each mounted rotatably on carrying levers which, for their part, are articulated, such that they are distributed uniformly in the circumferential direction, on a carrying disk which is driven in rotation about its axis. The rotary position of the circulatory elements and the pivoting position of the carrying levers are controlled by means of a control arrangement. At a pick-up location, the suction element of each circulatory element picks up in each case one supplementary product and leads it to a press-on location, where it is applied to one side of a printed product, of which the other side is supported by means of the supporting element of an adjacent circulatory element. Depending on the side of the printed products to which the supplementary products are to be adhesively bonded, the circulatory elements are rotated to one side or the other by means of the control arrangement, for which purpose conversion of the apparatus is necessary in each case.

SUMMARY OF THE INVENTION

It is an object of the present invention to develop the known apparatus such that the task of changing over the application of supplementary products from one side of the printed products to the other can take place easily and quickly.

The object is achieved by an apparatus of the generic type which has the features in the characterizing parts of claims 1 and 10.

The apparatus according to the invention makes it possible for the supplementary products to be optionally transferred from one circulatory element to an adjacent one.

A particularly preferred embodiment of the apparatus according to the invention is specified in claims 2 and 13. By virtue of a control section of the control arrangement being switched over, it is possible to change over from the supplementary products being applied to one side of the printed products to the other side, which can take place very quickly and virtually without any outlay being required.

Further preferred embodiments of the apparatus according to the invention are specified in the further claims.

BRIEF DESCRIPTION OF THE DRAWINGS

The invention will be explained in more detail with reference to exemplary embodiments illustrated in the drawing, in which, purely schematically.

DETAILED DESCRIPTION OF THE INVENTION

Figure 2:
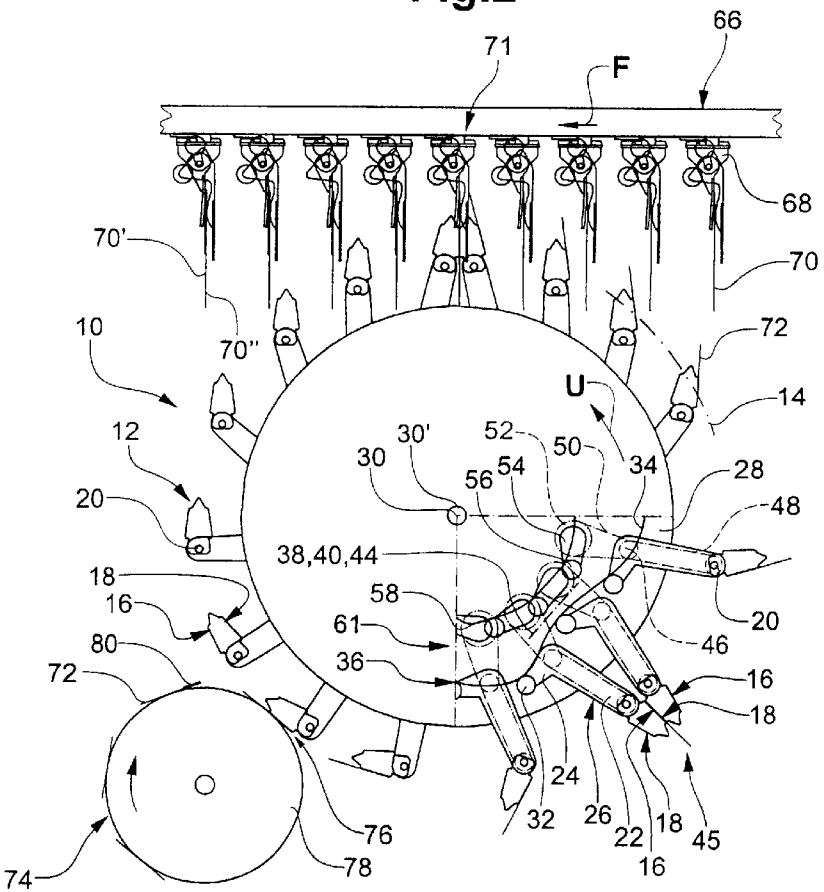
FIG. 2 shows, in the same illustration as in FIG. 1, the apparatus from the latter in a second mode of operation, in which the supplementary products are transferred to the preceding circulatory element in each case in order to be pressed onto the printed products on the other side.
Figure 1:
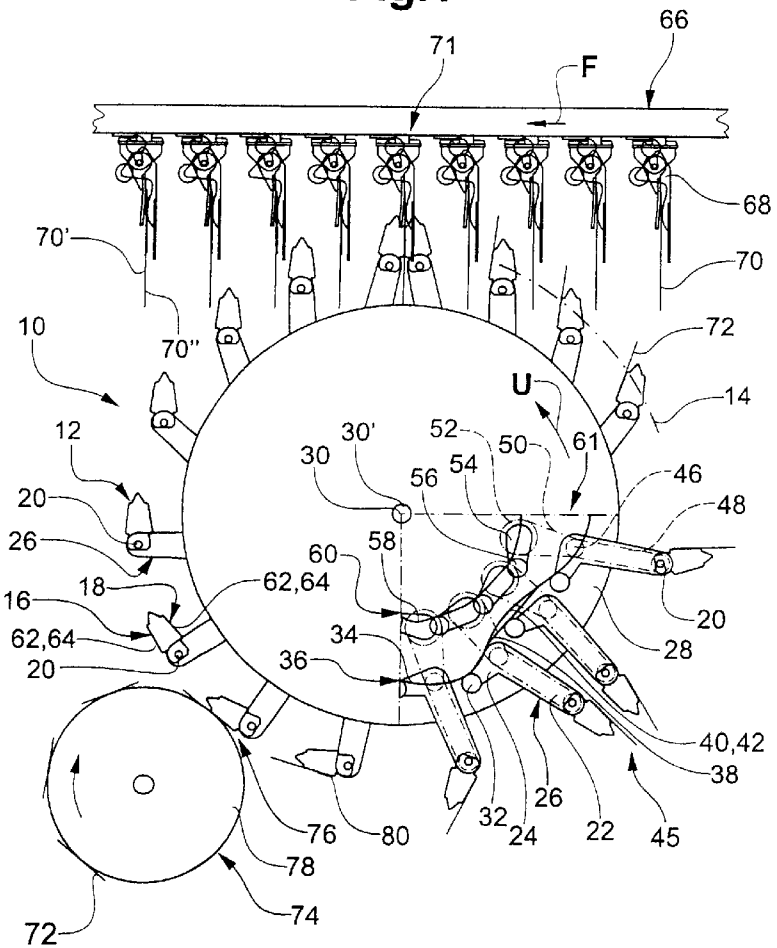
FIG. 1 shows a view, partly in section, of an apparatus according to the invention in a first mode of operation, a supply arrangement for supplying the supplementary products to the apparatus, and a conveying arrangement for transporting, in a hanging state, printed products onto which the supplementary products are pressed by means of the apparatus.

The apparatus 10 shown in FIGS. 1 and 2 has a number of circulatory elements 12, which are moved in a direction of circulation U along a more or less circular circulatory path 14 and are arranged one behind the other. The circulatory elements 12, which are of identical design, have a cross section similar to an isosceles trapezoid, the base of this cross section being arranged in a rotationally fixed manner on a shaft 20 in each case. Each of these shafts 20 is mounted in a freely rotatable manner at the free end of a first leg 22 of a carrying lever 26, which is designed as an angled lever and, for its part, is articulated on a carrying disk 28. The carrying disk 28 is driven continuously about its axis of rotation 30 in the direction of circulation U, the points of articulation of the carrying levers 26 being located on a circular line around the axis of rotation 30 and being distributed uniformly in the circumferential direction. Mounted in a freely rotatable manner on the second legs 24 of the carrying levers 26 are control rollers 32, which interact with a stationary pivoting guide 34 of a pivoting control means 36, said pivoting guide running around the axis of rotation. The pivoting control means 36 is assigned a switch-over element 40 which forms a control section 38 and can be changed over in the radially inward direction, in relation to the axis of rotation 30, from a rest position, which is shown in FIG. 1, into a transfer position 44. As can be gathered from FIG. 1, in the rest position 42 of the switch-over element 40, the control section 38 is located outside the pivoting guide 34, as seen in the radial direction, as a result of which a concave section of the pivoting guide 34 in a transfer region 45 of the circulatory path 14 is bridged and the control rollers 32 in this section interact with the control section 38 and are lifted off from the stationary pivoting guide 34. In the transfer position 44, however, as FIG. 2 shows, the control section 38 is located within the stationary pivoting guide 34, as seen in the radial direction, with the result that the control rollers 32 interact with the pivoting guide 34 along the entire extent of the same.

Mounted in a freely rotatable manner on the carrying disk 28, on the articulation pins 46 of the carrying levers 26, are coupling wheels which are drive-connected on the one hand, via a first drive belt 48, to the shafts 20, which bear the circulatory elements 12, and on the other hand, via a second drive belt 50, to control wheels 52, which are mounted on the carrying disk 28. Each of the control wheels 52 is fixedly connected to a control lever 54 which, at its free end, bears a control roller 56 which is mounted in a freely rotatable manner. The control rollers 56 interact with a stationary rotary guide 58. The rotary position of the circulatory elements 12 is controlled in a location-dependent manner by said rotary control means 60. The pivoting control means 36 and the rotary control means 60 together form a control arrangement 61 for the circulatory elements 12.

Figures 3, 4, 5, 6, 7, 8, 9:
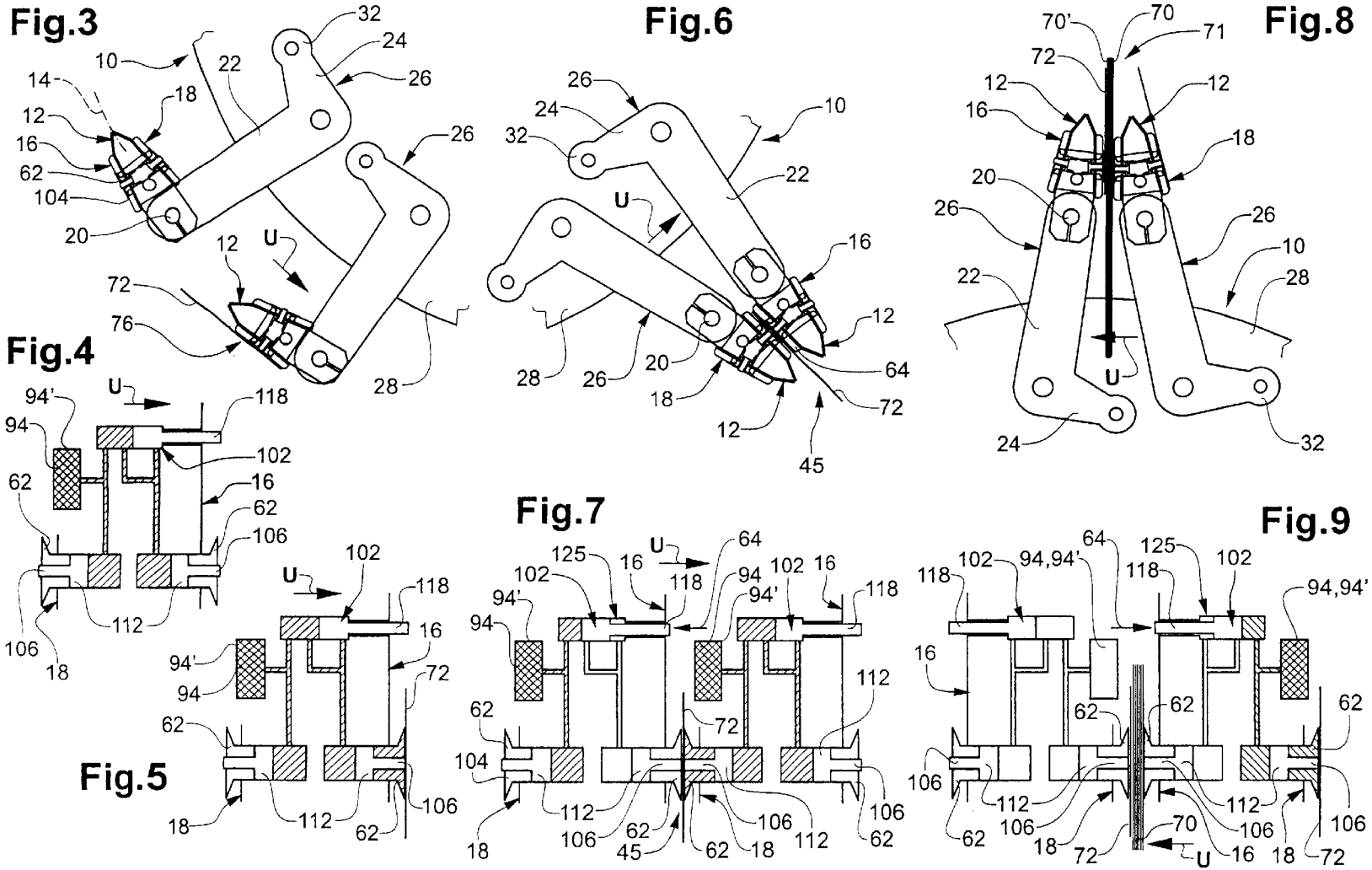
FIG. 3 shows a side view of part of the apparatus shown in FIGS. 1 and 2, with two circulatory elements, the leading one already having picked up a supplementary product.
FIG. 4 shows a schematic view of the pneumatic state of the circulatory element which is shown in FIG. 3 and has not yet picked up a supplementary product.
FIG. 5 shows, schematically, the pneumatic state of the circulatory element according to FIG. 3 which has already picked up a supplementary product.
FIG. 6 shows, in the same view as in FIG. 3, two adjacent circulatory elements during transfer of a supplementary product from one circulatory element to the preceding circulatory element.
FIG. 7 shows, schematically, the pneumatic state of the two circulatory elements shown in FIG. 6.
FIG. 8 shows, in the same illustration as in FIG. 6, the two circulatory elements from the latter as the supplementary product received by the leading circulatory element is pressed onto a printed product.
FIG. 9 shows, schematically, the pneumatic state of the two circulatory elements shown in FIG. 8.

Two spaced-apart carrying disks 28 are advantageously seated on a drive shaft 30', which is coaxial with the axis of rotation 30, mutually associated carrying levers 26 in each case which are connected to one another via a shaft 20, which bears a circulatory element 12, being articulated on said carrying disks, as is disclosed, in particular, in FIG. 6 of EP-A-1 112 861. The pivoting guide 34 and rotary guide 58 are likewise preferably formed on two fixed plates, on which the drive shaft 30' is mounted and which are located outside the carrying disks 28, as seen in the direction of the axis of rotation 30, this likewise being disclosed in EP-A-1 112 861.The switch-over element 40 is preferably arranged on the abovementioned plates, the rotary guide 58, which is otherwise formed as a groove-like depression of constant cross section in the plates, having a greater width in the region of the control section 38.

Each circulatory element 12 has a suction element 62 and a supporting element 64 in each case on a first side 16 and on a second side 18—which, in cross section, form the legs of the isosceles trapezoid. This will be described in more detail hereinbelow in conjunction with FIGS. 3 to 19.

Leading past above the apparatus 10 is a conveying arrangement 66, of which the transporting clamps 68, which are spaced apart one behind the other, are driven in a conveying direction F, synchronously with the apparatus 10. Each transporting clamp 68 secures a printed product 70—which may be a printed product with one or more sheets—and transports the same, in a hanging position, in the horizontal direction beyond the apparatus 10, although a top section of the circulatory path 14 of the circulatory elements 12 is located in the movement region of the printed products 70. Located at the top point of the circulatory path 14 is a press-on location 71, in which, as is yet to be described, supplementary products 72 are pressed onto the printed products 70 by means of the circulatory elements 12.

The supplementary products 72 are fed individually, by means of a supply arrangement 74, to a pick-up location 76, where they are received, in order to be transported further, by the circulatory elements 12 moving past the pick-up location 76. The supply arrangement 74, as is known, may be of different designs; in the present case it has a supply wheel 78.

The supplementary products 72 may be so-called Post-it® notes, which are provided with adhesive 80 in a strip-like region. However, they may also constitute other types of supplementary products 72 which, by means of the apparatus 10, are fed to the printed products 70 and pressed onto the latter in order for the supplementary products 72 to be adhesively bonded to the printed products 70.

The transfer region 45 and thus the switch-over element 40 with the control section 38 are located between the pick-up location 76 and the press-on location 71, in which case they are arranged downstream of the pick-up location 76 and upstream of the press-on location 71, as seen in the direction of circulation U.

FIGS. 3, 6, 8, 10, 13 and 15 each show a region of the carrying disk 28, which is driven continuously in rotation in the direction of circulation U, with two carrying levers 26, which are articulated on the carrying disk and each bear a circulatory element 12, at different points in time of an operating cycle. That position of the carrying levers 26 and circulatory elements 12 which is shown in these figures corresponds to that which they also assume at the relevant point in time in FIGS. 1 and 2. The same parts are provided with the same designations as in FIGS. 1 and 2.

Figure 18:
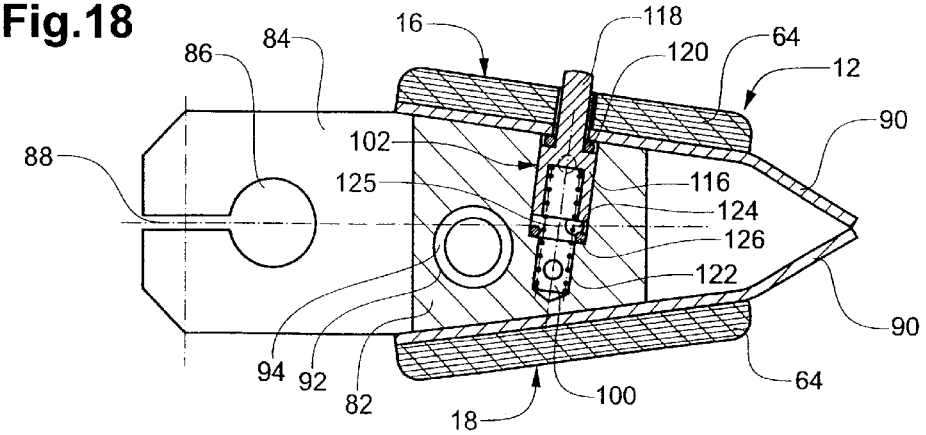
FIG. 18 shows a section along line XVIII—XVIII from FIG. 17 through the circulatory element with the air-admission valve installed.
Figure 19:
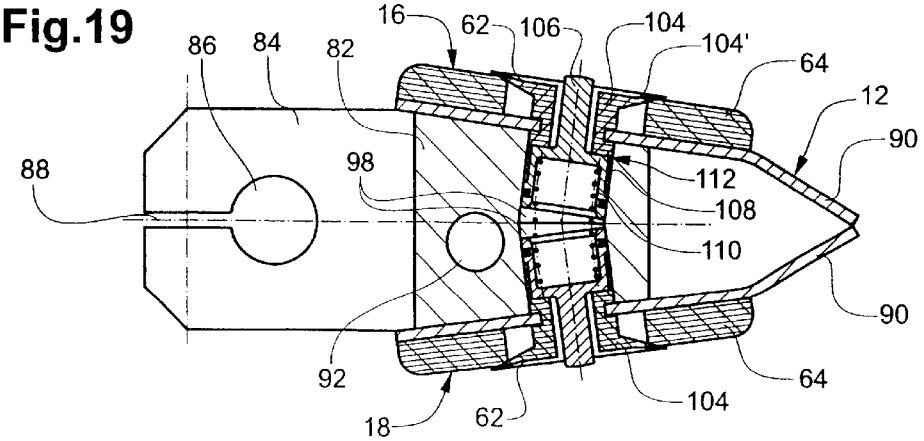
FIG. 19 shows a section along line XIX—XIX according to FIG. 17 through the circulatory element with the suction elements and integrated suction valves.

For better understanding of the functioning of the circulatory elements 12, and of FIGS. 4, 5, 7, 9, 11, 12, 14 and 16, which schematically illustrate the respective pneumatic state, the construction of the circulatory elements 12 will be described, for the time being, with reference to FIGS. 17 to 19.

Each of the circulatory elements 12 has a circulatory body 82 with a cross section in the form of an isosceles trapezoid, from which a fastening flange 84 projects on the side of the base of the cross section. From a fastening hole 86 in the fastening flange 84, a slot 88 runs to the free end of the fastening flange 84. This slot 88 can be narrowed by means of a screw, in order for the circulatory body 82 to be fastened in the desired rotary position on the shaft 20, which is guided through the fastening hole 86. Fastened in a flatly abutting manner against the outer surfaces of the circulatory body 82, said surfaces being arranged at an acute angle in relation to one another, are rectangular plates 90 which, on the side which is directed away from the fastening flange 84, project beyond the circulatory body 82 and are bent round toward one another, in order to butt against one another in the manner of a wedge at the free end.

Running through the circulatory body 82, parallel to the fastening hole 86, is a cutout 92, in which a generally known ejector 94 is installed. As is indicated by the arrow 96, this ejector is supplied with compressed air, in order to serve as a negative-pressure source 94'. The negative-pressure outlet of the ejector 94 is connected by means of bores in the circulatory body 82, on the one hand, to an accommodating opening 98, which is assigned to the second side 18 and is intended for a suction element 62, and, on the other hand, to a blind-hole-like accommodating opening 100 for an air-admission valve 102. The air-admission valve 102 is connected, by means of further bores, to a further accommodating opening 98 for the suction element 62 assigned to the first side 16.

The accommodating openings 98 run at right angles to the plate 90 and the relevant side of the circulatory body 82. Inserted into each of these accommodating openings 98 is a suction head 104, which is retained by the plates 90 in the manner of a groove/wedge connection and has a plate-rim-like sealing lip 104' at the outer, free end. An actuating shaft 106 engages through the central through-passage of the suction head 104, leaving an annular gap in the process, a cup-like valve body 108 being integrally formed at the inner end of said actuating shaft. The annular shoulder of the valve body 108, which adjoins the actuating shaft 106, interacts, as a sealing surface, with a valve seat which is formed by the inner end side of the suction head 104. Located in the interior of the valve body 108 is a compression spring 110, which forces the valve body 108 against the suction head 104 in the closed position. In this closed position, the actuating shaft 106 has its free end projecting beyond the suction head 104. The valve body 108 along with the actuating shaft 106 and the suction head 104 together form a self-closing suction valve 112 which, with the actuating shaft 106 forced inward, connects the suction head 104 to the negative-pressure source 94' and/or the air-admission valve 102. The compression spring 110 is coordinated with the pressure conditions such that the suction valve 112 is kept in the open position if a supplementary product 72, for example a paper sheet, is retained by the suction head 104.

A planar supporting element 64 in each case is arranged on the outer side of the plates 90 and around the suction head 104, this supporting element only being set back slightly in relation to the free end of the sealing lip 104'. The suction heads 104 are located approximately in the center of the side surfaces of the circulatory body 82 and of the supporting elements 64. In the direction of the fastening hole 86, the air-admission valve 102 is offset toward one end side of the circulatory body 82, in relation to the suction head 104 arranged on the same side. Inserted into the accommodating opening 100 is an air-admission-valve body 116, which is likewise of cup-like design and has an actuating pin 118 projecting beyond the associated supporting element 64. An O-ring 120 engages around said actuating pin and, in the closed position of the air-admission valve 102, closes off the accommodating opening 100 by butting against the relevant plate 90. The air-admission-valve body 116 is prestressed into the closed position likewise by means of a compression spring 122. That annular end side of the air-admission-valve body 116 which is directed away from the actuating pin 118 likewise forms a sealing surface 124, which, in an air-admission position 125 of the air-admission valve 102, interacts with an O-ring 126, which butts against a shoulder of the accommodating opening 100 and forms a further valve seat. Opening out adjacent to the base of the blind-hole-like accommodating opening 100 is the bore which connects the air-admission valve 102 to the negative-pressure source 94'. Opening out adjacent to the O-ring 126, in the vicinity of the O-ring 120, are the two further bores into the accommodating opening 100, these being connected to one another and to the suction element 62 with integrated suction valve 112 arranged on the same side 16. In the closed position of the air-admission valve 102, this position being shown in FIG. 18, the mouth opening located at the O-ring 126 is free, as a result of which the associated suction head 104 with integrated suction valve 112 is connected to the negative-pressure source 94'. If, in contrast, the air-admission-valve body 116, by virtue of the actuating pin 118 being subjected to force, is displaced into the air-admission position 125, in abutment against the O-ring 126, on the one hand the abovementioned connection is interrupted and, on the other hand, the associated suction element 62 has air admitted to it in that the mouth opening located at the O-ring 120 is released by the air-admission-valve body 116. The suction element 62 with integrated suction valve 112 assigned to the first side 16 is thus connected to the negative-pressure source 94' via the air-admission valve 102, which is likewise assigned to said side 16, while the suction element 62 with integrated suction valve 112 assigned to the second side 18 of the circulatory element 12 is always connected to the negative-pressure source 94'.

The schematic views in FIGS. 4, 5, 7, 9, 11, 12, 14 and 16 show the pneumatic state of one circulatory element 12, or of two adjacent interacting circulatory elements 12, at different points in time of an operating cycle. The schematic views show the ejector 94, which acts as a negative-pressure source 94', the suction element 62 with integrated suction valve 112 assigned to the first side 16 of the circulatory element 12, the air-admission valve 102, which is likewise assigned to this first side 16, the suction element 62 with likewise integrated suction valve 112 assigned to the second side 18, and the pneumatic connections, as have been described above in conjunction with FIGS. 17 to 19. The single hatching denotes negative pressure, and no hatching denotes ambient pressure. Cross-hatching means that the ejector 94 has been subjected to the action of compressed air and thus serves as a negative-pressure source 94'. If, however, the relevant rectangle has no hatching, this means that the negative-pressure source 94' is inactive, the ejector 94 not being subjected to the action of compressed air.

A suitable valve for connecting the ejector 94 to a compressed-air source in dependence on the rotary position, in particular, is a rotary valve, of generally known construction, controlled by the shaft 30.

The apparatus shown in FIGS. 1 to 19 can operate in two different modes, depending on whether the supplementary products 72 are to be applied to a leading side 70' or trailing side 70", as seen in the conveying direction F, of the printed products 70. For the time being, we will explain the mode of operation in the case of which the supplementary products 72 are to be pressed onto the leading side 70' of the printed products 70, and which is illustrated in FIG. 2 and in FIGS. 3 to 9. In this mode of operation, the switch-over element 40 with the control section 38 is located in the transfer position 44 and is thus inactive.

The circulatory elements 12, which are to be fed to the pick-up location 76 one after the other in the direction of circulation U, have been rotated into a position in which they are trailing in relation to the associated carrying lever 26 and are arranged with the free end oriented counter to the direction of circulation U. In this case, the surface of the supporting elements 64 assigned to the outer, first side 16 runs at least more or less tangentially to the circulatory path 14, as FIG. 3 shows. The first legs 22 of the carrying levers 26 here are retained approximately in the radial direction.

It should first be mentioned that, apart from at the press-on location 71, the ejector 94 is permanently subjected to the action of compressed air.

As FIG. 4 shows, in the case of the circulatory elements 12 which are to be fed to the pick-up location 76, the two suction valves 112 and the air-admission valve 102 are located in the closed position, while the negative-pressure source 94 is activated. Upon reaching the pick-up location 76, the circulatory element 12 positions itself flatly, by way of the suction head 104 of the suction element 62 assigned to the first side 16, against the exposed side of a supplementary product 72, which, retained on the other side by the supply wheel 78, is fed to the pick-up location 76 at a speed corresponding at least more or less to the speed of circulation of the circulatory element 12 (see FIG. 2). In this case, the suction valve 112 assigned to said suction element 62 is opened by the relevant actuating shaft 106 being actuated by the supplementary product 72. As FIG. 5 shows, said suction valve 112 is kept in the open position since the supplementary product 72 retained by the suction element 62 prevents the valve body 108 from moving back and thus prevents the suction valve 112 from closing. The supplementary product 72 is thus retained by the relevant suction element 62 in order to be transported further.

Once they have left the pick-up location 76, the circulatory elements 12 are pivoted, by means of the rotary control means 60, into an approximately radially running position, which they assume upon reaching the transfer region 45.

In the transfer region 45, the pivoting guide 34 and the rotary guide 58 are formed such that the carrying levers 26 are pivoted first of all in the direction of circulation U, and then counter to the direction of circulation U, such that two adjacent circulatory elements 12 position themselves against one another by way of the supporting elements 64, the second side 18 of the respectively leading circulatory element 12 and the first side 16 of the trailing circulatory element 12 clamping in between them the supplementary product 72 fed by said trailing circulatory element. With this positioning against one another, that supporting element 64 of the leading circulatory element 12 which is assigned to the side 18 actuates the air-admission valve 102 of the trailing circulatory element 12, as can be seen from FIG. 7 in particular. At the same time, the suction valve 112 assigned to the second side 18 of the leading circulatory element 12 is opened by the supplementary product 72. This results in the supplementary product 72, now retained by the relevant suction element 62, being transported further, while it is released by the suction element 62 assigned to the trailing circulatory element 12 since the relevant suction head 104 has been disconnected from the associated negative-pressure source 94' by means of the air-admission valve 102 and has been connected to the surroundings.

The subsequent pivoting of the carrying lever 26 in the direction of circulation U results in the leading circulatory element 12, which now bears the supplementary product 72, moving away from the trailing circulatory element 12, as a result of which the air-admission valve 102 and the associated suction valve 112 of the trailing circulatory element 12 change over again into the closed position. In this way, the supplementary products 72 are discharged in the transfer region 45 from the trailing circulatory element 12 to the respectively preceding circulatory element 12, the side being changed over at the same time.

Downstream of the transfer region 45, the circulatory elements 12 are rotated such that they have their free end, tapering in a wedge-shaped manner, oriented in the direction of the conveying arrangement 66, and the carrying levers 26 are controlled such that the circulatory elements 12 mesh with the printed products 70, which are transported in a hanging state, i.e. in each case one circulatory element 12 is moved in between two adjacent printed products 70. In other words, a circulatory element 12 is then located on both sides of each printed product 70, the circulatory elements 12 then bearing the supplementary products 72 on their trailing side 18, as seen in the direction of circulation U.

On approaching the press-on location 71, the carrying lever 26 assigned to the respectively leading circulatory element 12 is pivoted counter to the direction of circulation U and that carrying lever 26 assigned to the trailing circulatory element 12 is pivoted in the direction of circulation U, which results in the leading circulatory element 12 positioning itself, by way of the supplementary product 72, on the leading side 70' of the printed product 70 and the trailing element 12 positioning itself, by way of its supporting element 64 assigned to the first side 16, without any supplementary product, on the trailing side 70" of the printed product. As a result, the supplementary product 72 is pressed onto the printed product 70, with the result that, if it is provided with an adhesive, it is fastened on the printed product 70.

The carrying levers 26 of the relevant circulatory elements 12 are then pivoted away from one another in order to release the printed product 70 with the supplementary product 72 fastened thereon. As movement continues in the direction of the pick-up location 76, the circulatory elements 12 and the carrying levers 26 are displaced into the position which is necessary for picking up a new supplementary product 72.

FIGS. 8 and 9 show the situation at the press-on location 71. The air-admission valve 102, which is assigned to the leading, first side of the trailing circulatory element 12, as seen in the direction of circulation U, has been moved out of the closed position into the air-admission position 125 by the opposite supporting element 64 of the leading circulatory element 12 and/or the printed product 70, as a result of which the associated suction head 104 has air admitted to it. The latter thus cannot secure the printed product 70. For the purpose of releasing the supplementary product 72, the compressed-air fed to the ejector 94 of the leading circulatory element 12 is interrupted, as a result of which the negative pressure in the circulatory element 12 is dissipated and the supplementary product 72 can be released.

Figures 10, 11, 12, 13, 14, 15, 16:
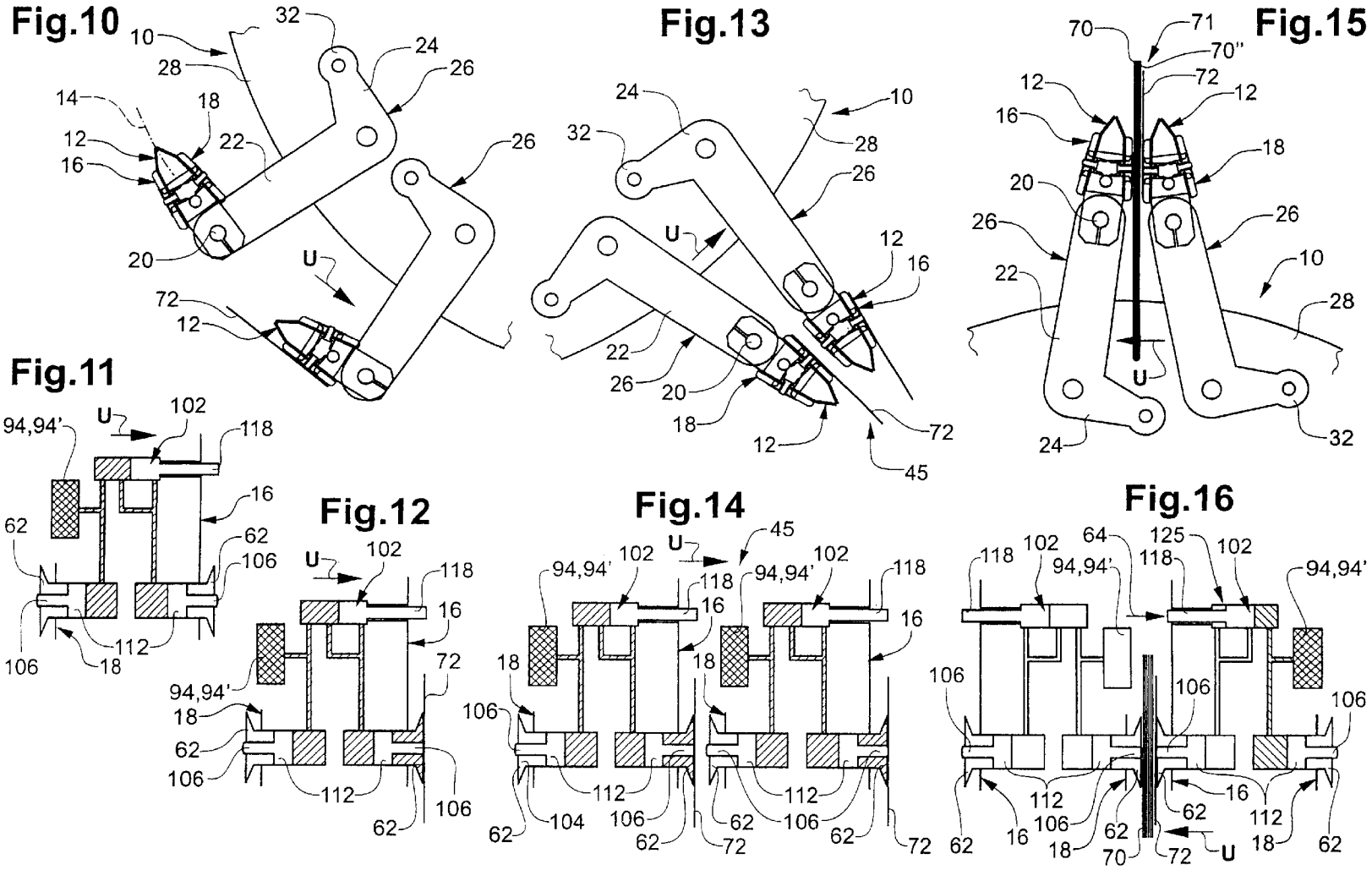
FIG. 10 shows, as in FIG. 3, the two circulatory elements from the latter respectively with and without a supplementary product.
FIG. 11 shows, schematically, corresponding to FIG. 4, the pneumatic state of the circulatory element which does not retain a supplementary product in FIG. 10.
FIG. 12 shows, schematically, corresponding to FIG. 5, the pneumatic state of the circulatory element which retains a supplementary product in FIG. 10.
FIG. 13 shows, corresponding to FIG. 6, two circulatory elements in a second mode of operation of the apparatus according to the invention, in which no transfer of the supplementary products from one circulatory element to the other takes place.
FIG. 14 shows, schematically, the pneumatic state of the two circulatory elements shown in FIG. 13.
FIG. 15 shows, corresponding to FIG. 8, the two circulatory elements from FIG. 13 as the supplementary product retained by the trailing circulatory element is pressed onto a printed product.
FIG. 16 shows, schematically, corresponding to FIG. 9, the pneumatic state of the circulatory elements according to FIG. 15.

In the case of the mode of operation shown in FIGS. 1 and 10 to 16, the supplementary products 72 are received individually at the pick-up location 76 in the same way as has been described above in conjunction with the first mode of operation. FIGS. 10, 11 and 12 are thus identical to FIGS. 3, 4 and 5. Upon reaching the transfer region 45, each circulatory element 12 bears a supplementary product 72 on its first, front side 16, as seen in the direction of circulation U.

As is shown in FIG. 1, the control section 38 is located in the rest position 42, as a result of which adjacent,circulatory elements 12 are prevented from moving toward one another until they butt against one another while clamping the relevant supplementary product 72 in between them. In other words, the control section 38, in the rest position 42, ensures that the circulatory elements 12, as they run through the transfer region 45, are always spaced apart from one another to a sufficient extent, with the result that there is no transfer of the supplementary product 72 from the trailing to the preceding circulatory elements 12. FIGS. 13 and 14 show these two adjacent and spaced-apart circulatory elements 12 in the transfer region 45.

In that section of the circulatory path 14 which follows the transfer region 45, as far as the press-on location 71, the circulatory elements 12 and carrying levers 26 are rotated and/or pivoted in the same way as has been described above in conjunction with the first mode of operation. The circulatory elements 12 then bear the supplementary products 72, retained on the leading, first side 16, to the press-on location 71, which results in supplementary products 72 then being positioned on the trailing side 70" of the printed products 70, while the printed products 70 are supported on the leading side 70' by the preceding circulatory element 12.

It should be mentioned that, apart from in the region of the control section 38, irrespective of the mode of operation, the circulatory elements 12 and the carrying levers 26 are rotated and/or controlled in the same manner, with the result that, irrespective of the mode of operation, the position of the circulatory elements 12 is the same everywhere, apart from when they move through the transfer region 45.

Figure 20:
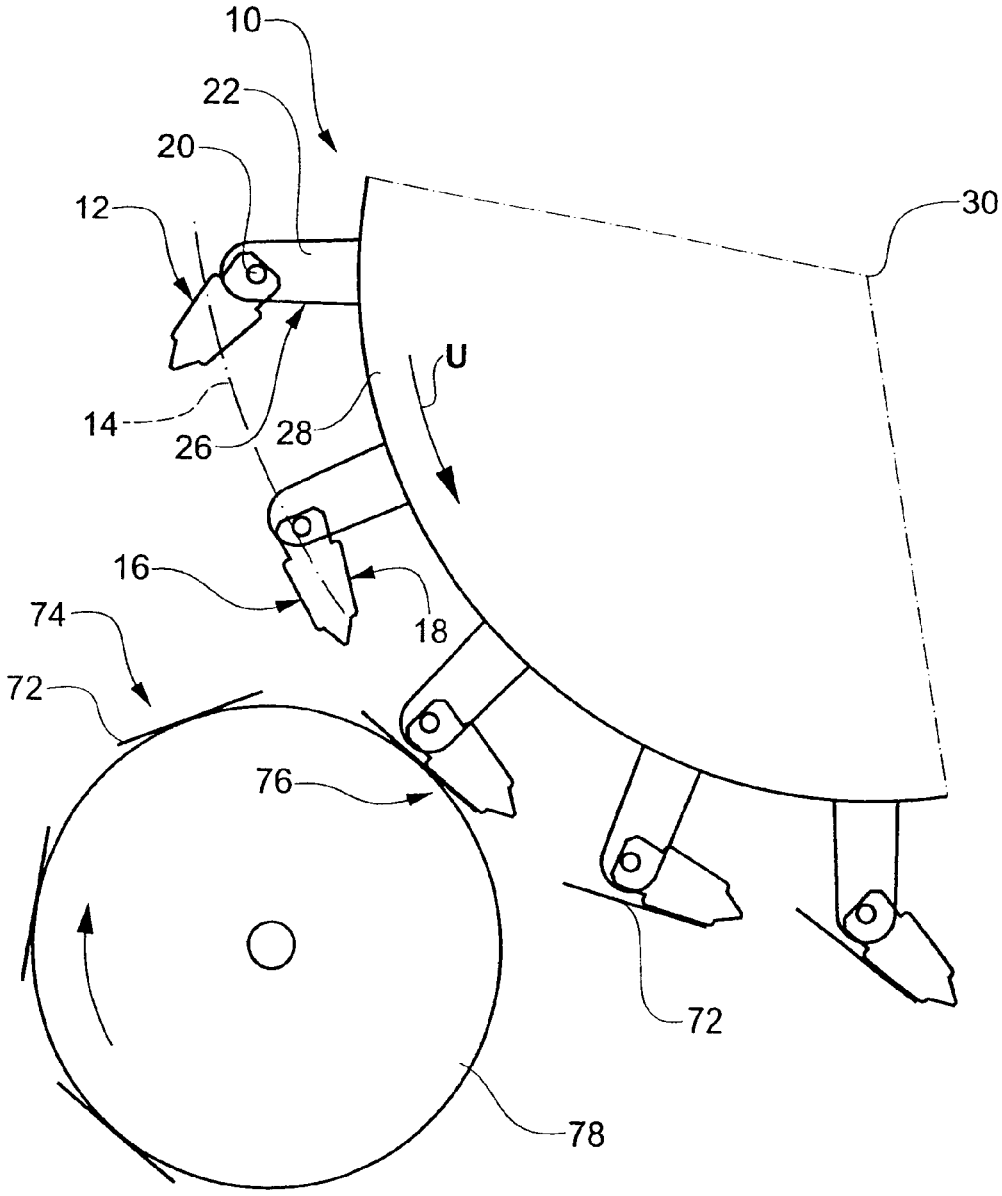
FIG. 20 shows a view of part of the apparatus according to the invention in an embodiment in which the circulatory elements are directed forward, as seen in the direction of circulation, for the purpose of picking up a supplementary product.

FIG. 20 shows an embodiment which is very similar to the above-described embodiment, although in this case, for the purpose of picking up the supplementary products 72 at the pick-up location 76, the circulatory elements 12 are aligned such that their free, wedge-shaped end is oriented forward, as seen in the direction of circulation U. It is also the case here that the circulatory elements 12 are of the same design as is shown in FIGS. 17 to 19, although they are fastened the other way round on the shafts, with the result that, in turn, the first side 16 is directed toward the supply arrangement 74 and the second side 18 is directed away from said supply arrangement. Furthermore, the construction and the functioning of the apparatus is the same as has been described above in conjunction with FIGS. 1 to 16. If the control section 38 is located in the transfer position 44, the supplementary products 72 are transferred to the trailing circulatory element 12 from the respectively preceding one.

Figure 21:
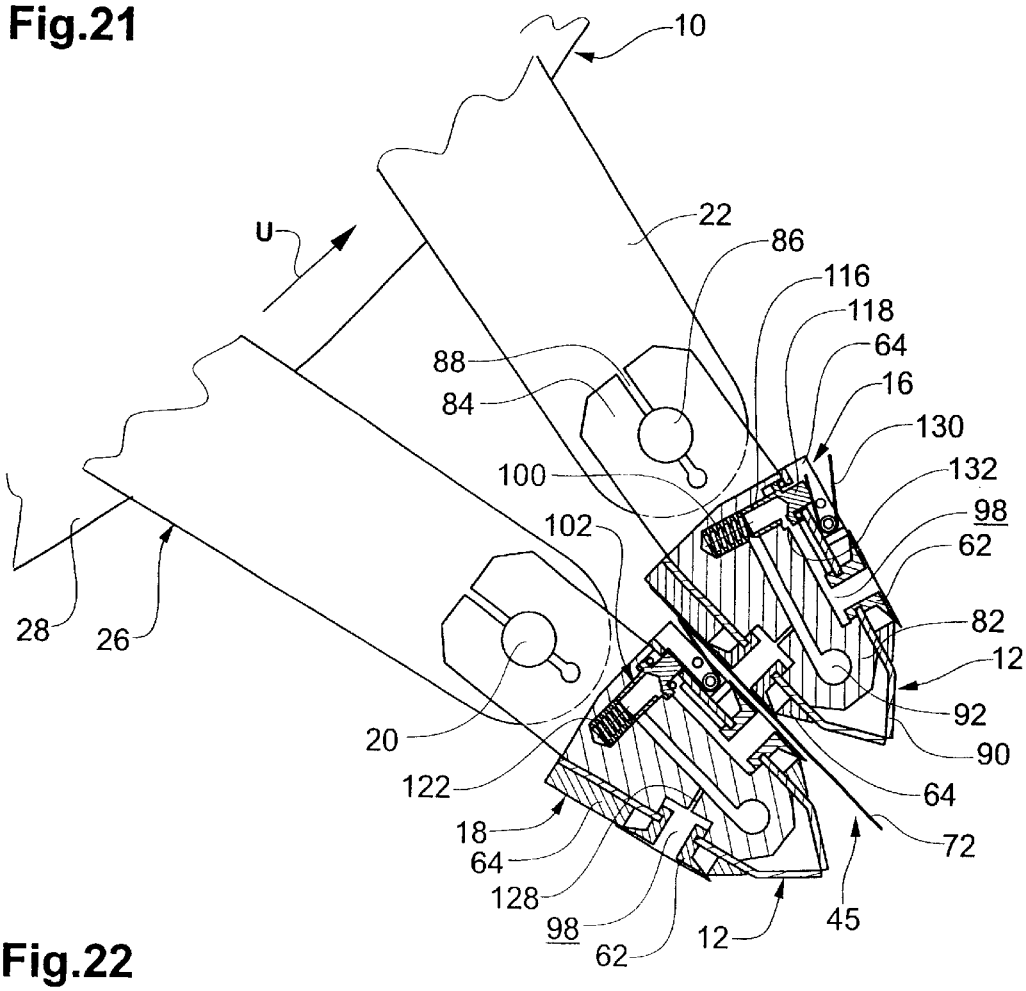
FIG. 21 shows, corresponding to FIG. 6 but on an enlarged scale, two adjacent circulatory elements—constructed differently from FIGS. 3 to 19—during transfer of a supplementary product from one circulatory element to the preceding circulatory element.

FIG. 21 illustrates a further embodiment of the circulatory elements 12. Here too, each circulatory element 12 has a suction element 62 and a supporting element 64 in each case on the first side 16 and on the second side 18, which form the legs of the isosceles trapezoid in cross section.

FIG. 21 shows a region of the carrying disk 28, which is driven continuously in rotation in the direction of circulation U, with two carrying levers 76, which are articulated thereon and each bear a circulatory element 12, at the same point in time of an operating cycle as FIG. 6. Equivalent parts are provided with the same designations in FIG. 21 as in FIGS. 1 to 19. The apparatus according to FIG. 21 is of the same construction, and operates in the same way, as the apparatus according to FIGS. 1 to 19, with the following exceptions.

Figure 17:
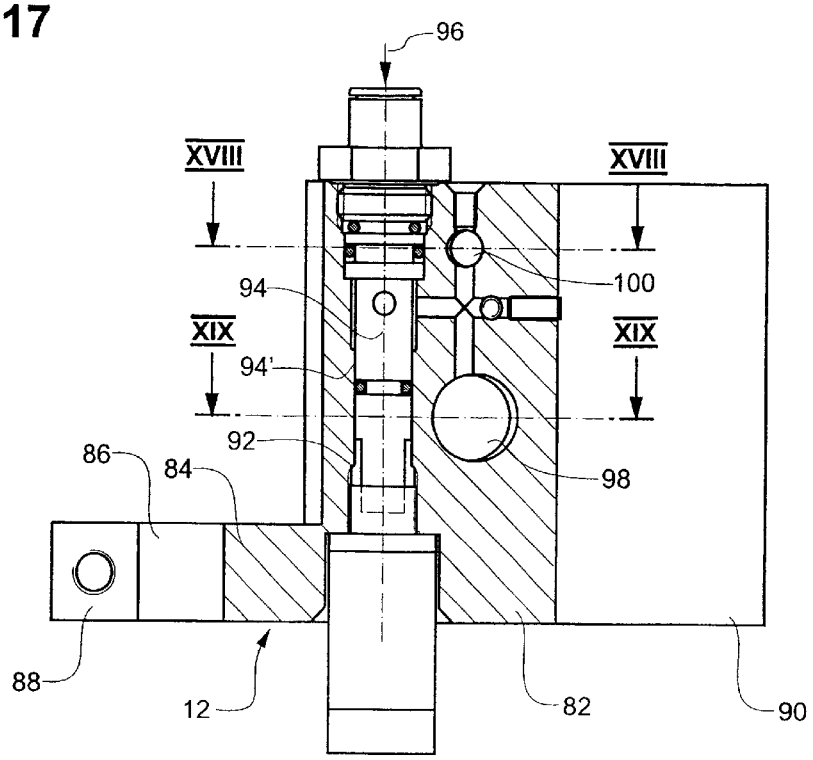
FIG. 17 shows a side view, partly in section, of a circulatory element with an ejector installed and the cutouts for accommodating suction elements with integrated suction valve and an air-admission valve.

Installed in the cutout 92 is an ejector 94 which, supplied with compressed air, serves as a negative-pressure source 94', see also FIG. 17. The negative-pressure outlet of the ejector 94 is connected to the blind-hole-like accommodating opening 100 for the air-admission valve 102 by means of a bore in the circulatory body 82. Branching off from the abovementioned bore is a smaller-diameter bore—forming a restrictor 128—which opens out into that accommodating opening 98 for the suction element 62 which is assigned to the second side 18. The second accommodating opening 98, for the suction element 62 assigned to the first side 16, is connected to the air-admission valve 102 by means of a further bore, of which the cross section corresponds approximately to the cross section of the bore leading away from the ejector. The suction elements 62, however, are not assigned any suction valves 112, compare with FIG. 19 in particular.

The axes of the suction elements 62 and of the air-admission valve 102 are located in a plane which runs at right angles to the shaft 20 and centrally through the circulatory body 82, the air-admission valve 102 being arranged closer to the shaft 20 than the suction elements 62.

The air-admission-valve body 116, which is of cup-like design and is inserted into the accommodating opening 100, has its actuating pin 118 projecting beyond the relevant plate 90 into a cutout of the supporting element 64. Arranged in said cutout is a leg spring 130, which is mounted on the supporting element 64 and has one leg interacting with the actuating pin 118 and its other leg projecting beyond the supporting element 64. The leg spring 130 is designed such that, when the projecting leg is subjected to force, it can displace the air-admission-valve body 116, counter to the force of the compression spring 122, from the closed position, which is shown in the leading circulatory element 12, into the air-admission position, which is illustrated in the trailing circulatory element 12.

In the closed position, the O-ring engaging around the actuating pin 118 closes off the accommodating opening 100 in relation to the surroundings by virtue of butting against the plate 90. A restrictor through-passage 132 in the air-admission-valve body 116 in this case connects the associated suction element 62 to the negative-pressure source 94'. The cross section of the restrictor through-passage 132 corresponds approximately to that of the restrictor 128. In the air-admission position, the throttle through-passage 132 is closed and separated off from the associated suction element 62; the suction element 62 is connected to the surroundings by way of an air gap between the plate 90 and the actuating pin 118 because, as a result, the O-ring is lifted off from the plate 90 and the air gap is connected to the bore leading to the accommodating opening 98.

The transfer of a supplementary product 72 from the front, first side 16 of the trailing circulatory element 12 to the rear, second side 18 of the leading circulatory element 12 will be explained with reference to the schematic view of the pneumatic state from FIG. 22. The hatching has the same meanings as have been explained above for FIGS. 4, 5, 7, 9, 11, 12, 14 and 16.

At the pick-up location 76, see FIG. 2, each circulatory element 12 receives a supplementary product 72 by way of its first side 16. In this case, the air-admission valve 102 is located in the closed position and the two suction elements 62 are connected to the activated negative-pressure source 94'. In the transfer region 45, the respectively adjacent, approximately radially pivoted circulatory elements 12 are moved toward one another, as a result of which that supporting element 64 of the leading circulatory element 12 which is assigned to the second side 18, by acting on the projecting leg of the leg spring 130, changes over the air-admission valve 102 of the trailing circulatory element 12 into the air-admission position. The suction element 62 which has retained the supplementary product 72 up until that point releases the supplementary product 72, which, at the same time, is attached by suction, by that suction element 62 of the leading circulatory element 12 which is assigned to the second side 18, and is secured in order to be transported further.

At the pick-up location 76, the supplementary products 72 are preferably received by the circulatory elements 12 such that, during transfer in the transfer region 45, the relevant supplementary product 72 is clamped in between the supporting element 64 of the leading circulatory element 12 and the leg spring 130 of the trailing circulatory element 12. The supplementary product 72 is thus retained at all times even if the relevant suction elements 62 are not moved closely enough toward one another for them to come into contact with the supplementary product 72 from both sides at the same time.

At the press-on location 71, see FIG. 2, the supplementary product 72 is released by virtue of the ejector 94 being separated from the compressed-air source. If, however, there is no transfer of the supplementary product 72 in the transfer region, the supplementary product 72 is released by virtue of the air-admission valve 102 being actuated.

Figure 22:
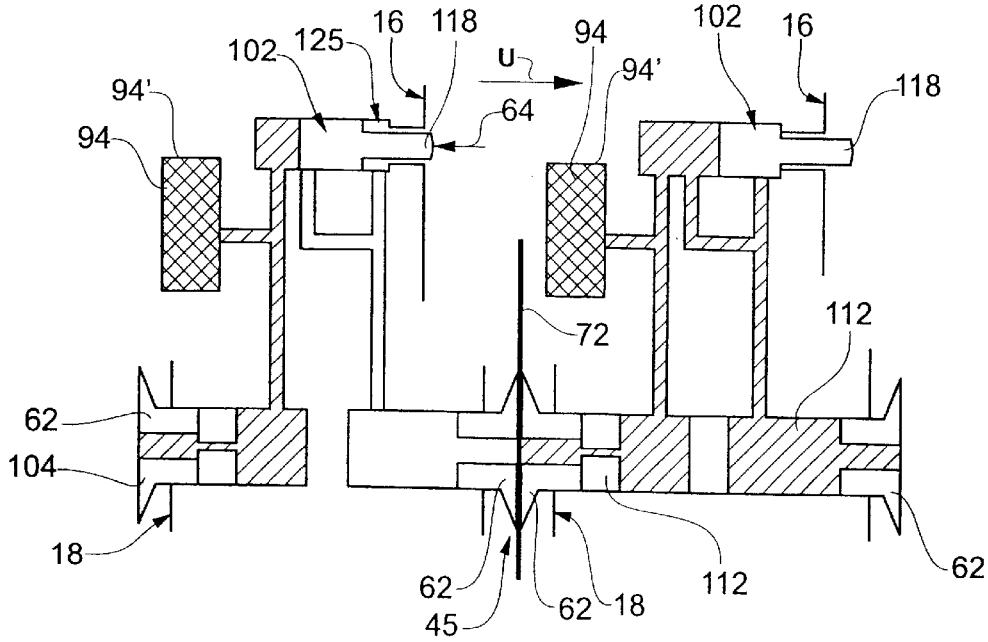
FIG. 22 shows, schematically, the pneumatic state of the two circulatory elements shown in FIG. 21.

In the case of the embodiment according to FIGS. 21 and 22, the pneumatic losses are likely to be somewhat greater in comparison with the above-described embodiment, but they are kept within acceptable limits by the restrictor 128 and the restrictor through-passage 132. The construction of the circulatory elements 12, however, is simplified considerably, and it is indeed possible to dispense with the suction valves 112.

What has been said above in relation to FIG. 20 also applies analogously to an apparatus with circulatory elements according to FIGS. 21 and 22.

It is conceivable for the circulatory elements 12 to be designed in some other manner and, in particular, for the suction and/or air-admission valves 112, 102 integrated in the circulatory elements 12 to be actuated, for example, via stationary guides rather than by means of the adjacent circulatory elements 12. It is also conceivable for the above-mentioned valves to be arranged outside the circulatory elements 12, with the result that the latter are equipped just with the suction elements 62. In the case of the embodiment with suction valves 112, it is also possible to dispense with the air-admission valves 102 in the circulatory elements 12, for example if the suction elements 62 are activated individually.

Instead of the carrying disks 28, it is also possible to use a star wheel. It is also conceivable for the circulatory elements to be guided on a rail.

What is claimed is:

1. An apparatus for supplying supplementary products to printed products and pressing them onto the latter, having a number of circulatory elements which are driven in a direction of circulation along a continuous circulatory path, are arranged one behind the other and have a suction element at least on one side and a supporting element at least on the other side, and having a control arrangement for the location-dependent control of the circulatory elements, it being the case that the circulatory elements are intended for picking up a supplementary product by means of the suction element at a pick-up location and pressing it onto a printed product at a press-on location, for which purpose the circulatory elements, during their movement from the pick-up location to the press-on location, are moved in between printed products, which are conveyed at a distance apart from one another, and are moved toward one another, with the result that one circulatory element positions itself, by way of the retained supplementary product, on one side of the printed products in each case and an adjacent circulatory element positions itself, by way of the supporting element, on the other side, wherein the circulatory elements have a suction element and a supporting element on both sides in each case, and each suction element, for the purpose of controlling its connection to a negative-pressure source, is assigned a suction valve.

2. The apparatus as claimed in claim 1, wherein the control arrangement has a control section which is arranged downstream of the pick-up location and upstream of the press-on location, as seen in the direction of circulation, and can be switched over from a rest position into a transfer position, it being the case that, in the transfer position, successive circulatory elements in each case are moved toward one another in order for the supplementary product retained by one circulatory element to be transferred to the adjacent circulatory element.

3. The apparatus as claimed in claim 2, wherein the circulatory elements are mounted rotatably on carrying levers which, for their part, are articulated, such that they are distributed uniformly in the circumferential direction, on a carrying element which is driven in rotation about an axis, and the control arrangement has a rotary control means for the rotary position of the circulatory elements and a pivoting control means for the carrying levers.

4. The apparatus as claimed in claim 3, wherein the switch-over control section is assigned to the pivoting control means.

5. The apparatus as claimed in claims 1, 2, 3 or 4, wherein the position of the circulatory elements remains unchanged in the pick-up location and in the press-on location, irrespective of the mode of operation.

6. The apparatus as claimed in claim 1, wherein the suction valves are of self-closing design and are kept in the open position by means of the supplementary product retained by the associated suction element.

7. The apparatus as claimed in claim 6, wherein the suction valves are arranged in the associated suction elements and each have an actuating element, which projects beyond the suction element.

8. The apparatus as claimed in claim 1, wherein each circulatory element has an air-admission valve, of which the actuating element can be changed over by the adjacent circulatory element, for transfer of the relevant supplementary product, into an air-admission position, in which the relevant suction element has air admitted to it.

9. The apparatus as claimed in claim 8, wherein each circulatory element has a negative-pressure source which is connected to one suction element, having a suction valve, directly and to the other suction element, likewise having a suction valve, via the air-admission valve.

10. An apparatus for supplying supplementary products to printed products and pressing them onto the latter, having a number of circulatory elements which are driven in a direction of circulation along a continuous circulatory path, are arranged one behind the other and have a suction element at least on one side and a supporting element at least on the other side, and having a control arrangement for the location-dependent control of the circulatory elements, it being the case that the circulatory elements are intended for picking up a supplementary product by means of the suction element at a pick-up location and pressing it onto a printed product at a press-on location, for which purpose the circulatory elements, during their movement from the pick-up location to the press-on location, are moved in between printed products, which are conveyed at a distance apart from one another, and are moved toward one another, with the result that one circulatory element positions itself, by way of the retained supplementary product, on one side of the printed product in each case and an adjacent circulatory element positions itself, by way of the supporting element, on the other side, wherein the circulatory elements have a suction element and a supporting element on both sides in each case, and each circulatory element is assigned an air-admission valve including an actuating element, of which the actuating element can be changed over for transfer of a supplementary product, into an air-admission position, in which the relevant suction element has air admitted to it.

11. The apparatus as claimed in claim 10, wherein each circulatory element has a negative-pressure source which is connected to one suction element directly and to the other suction element via the air-admission valve.

12. The apparatus as claimed in claim 11, wherein in each case one restrictor element is provided between the negative-pressure source and the two suction elements.

13. The apparatus as claimed in claim 10, wherein the control arrangement has a control section which is arranged downstream of the pick-up location and upstream of the press-on location, as seen in the direction of circulation, and can be switched over from a rest position into a transfer position, it being the case that, in the transfer position, successive circulatory elements in each case are moved toward one another in order for the supplementary product retained by one circulatory element to be transferred to the adjacent circulatory element.

14. The apparatus as claimed in claim 13, wherein the circulatory elements are mounted rotatably on carrying levers which, for their part, are articulated, such that they are distributed uniformly in the circumferential direction, on a carrying element which is driven in rotation about an axis, and the control arrangement has a rotary control means for the rotary position of the circulatory elements and a pivoting control means for the carrying levers.

15. The apparatus as claimed in claim 14, wherein the switch-over control section is assigned to the pivoting control means.

16. The apparatus as claimed in claim 15, wherein the position of the circulatory elements remains unchanged in the pick-up location and in the press-on location, irrespective of the mode of operation.

17. The apparatus as claimed in claim 9, wherein said negative pressure source is in the form of an ejector supplied with compressed air.

18. The apparatus as claimed in claim 10, wherein said actuating element is changed over by the adjacent circulatory element.

19. The apparatus as claimed in claim 11, wherein said negative pressure source is in the form of an ejector supplied with compressed air.

* * * * *